United States Patent [19]

Campillo et al.

[11] Patent Number: 4,494,767

[45] Date of Patent: Jan. 22, 1985

[54] LOCKING DEVICE FOR A SKI BINDING

[75] Inventors: Christian Campillo, Garchizy; Jean-Pierre Michaud, Clamart, both of France

[73] Assignee: Ste Look, Nievre, France

[21] Appl. No.: 373,844

[22] Filed: May 3, 1982

[30] Foreign Application Priority Data

May 22, 1981 [FR] France ..... 81 10210

[51] Int. Cl.[3] ..... A63C 9/084

[52] U.S. Cl. ..... 280/612; 280/632; 280/634

[58] Field of Search ..... 280/612, 626, 631, 632, 280/634

[56] References Cited

U.S. PATENT DOCUMENTS 3,794,339 2/1974 Smolka ..... 280/612

FOREIGN PATENT DOCUMENTS 1578751 12/1970 Fed. Rep. of Germany .
2165481 8/1972 Fed. Rep. of Germany .
2535568 2/1977 Fed. Rep. of Germany .
2902165 7/1980 Fed. Rep. of Germany ..... 280/632
2146251 9/1973 France .
2418655 11/1979 France ..... 280/612

*Primary Examiner*—David M. Mitchell
*Assistant Examiner*—Joseph G. McCarthy
*Attorney, Agent, or Firm*—Jordan B. Bierman

[57] ABSTRACT

The device comprises a locking lever having a bearing surface adapted to cooperate with a complementary bearing surface formed on a heel-gripping member. The angle of slope of the two surfaces is such that the resultant force of the bearing force and the friction force passes through the axis of rotation of the locking lever.

3 Claims, 3 Drawing Figures

LOCKING DEVICE FOR A SKI BINDING

This invention relates to a locking device for a ski binding.

A large number of publications have already described safety ski bindings in which a locking device is actuated automatically in the direction of unlocking upon energization of a suitable electric circuit. This circuit delivers a trip signal when the stresses exerted on the skier's leg and detected by suitable pickup devices attain a dangerous level in time-duration and /or in amplitude.

A considerable difficulty which arises in the design of this type of ski binding is the supply of power. Very large forces in fact appear while skiing is in progress and tend to separate the boot from the ski. It is usually at the moment when these forces have attained their maximum value that opening of the ski binding must take place. In point of fact, these forces are transmitted to the locking device. In order to actuate this device in the direction of unlocking, it is therefore necessary to overcome very large friction forces and consequently to deliver very high power to the device unlocking mechanism in a very short time, usually by means of a pyrotechnic or electromagnetic device.

Various proposals have been made for overcoming this difficulty such as, in particular, the use of rolling elements or antifriction surfaces and systems comprising force-reduction levers. Unfortunately, these improvements have not been entirely satisfactory and the power consumption of this type of ski binding is still distinctly excessive at the present time. It is probably for this reason that bindings of this type are not commercially available since they make it necessary either to use very costly dry-cell battery units of a special type, or to change dry-cell batteries at very frequent intervals. These requirements,, however, are unacceptable in practice.

This invention therefore proposes to solve the difficulties. Accordingly, the locking device contemplated by the present invention comprises two movable elements applied against each other, at least one element being constituted by a lever pivotally mounted on a pin. The bearing surfaces of said elements are so arranged that the geometrical resultant of the force of application of the two surfaces against each other (the force which is normal to the surfaces) and of the friction force(tangent to said surfaces) passes through the axis of pivotal attachment of the locking lever and consequently applies a zero torque on said lever. Only a very small effort and correlatively low power is therefore required in order to initiate the unlocking operation.

Other features of the invention will be more apparent upon consideration of the following description and accompanying drawings, wherein.

Figure 1:
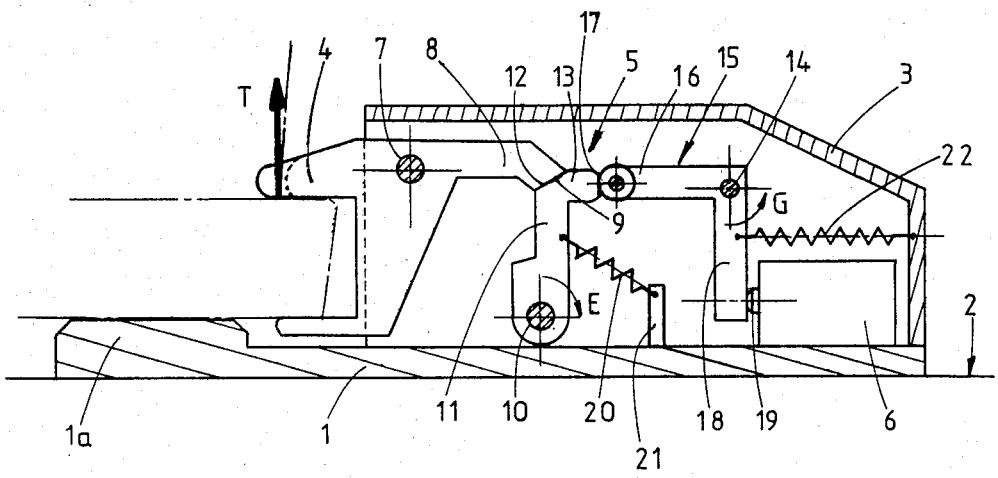
FIG. 1 is a vertical sectional view of the device in the locked state.

The ski binding illustrated in FIG. 1 is a heelholding member which is intended to cooperate with the heel of the ski boot (represented by a chain-dotted line) for normally maintaining the binding in a position in which it is applied against the ski.

The binding comprises a base plate 1 fixed by suitable means of screws (not shown) on the surface such as the ski 2, a portective casing 3, a heel-gripping member 4, a locking device 5 and an electromagnet 6.

The heel-gripping member 4 is pivotally mounted on a cross-pin 7 carried by the casing 3. Said member has an extension or locking arm 8 which extends towards the rear end of the ski within the interior of the casing 3 and has an inclined surface 9, the intended function of which will be explained below.

Within the interior of the casing 3, two levers 11, 15 respectively are pivotally mounted on cross-pins 10, 14 carried by the casing. The lever 11 has an inclined surface 12 which normally bears against the surface 9 of the arm 8 as well as a projecting portion 13 which is directed towards the rear end of the ski. The lever 15 has the shape of an L, the normally horizontal arm 16 of which is applied against the projecting portion 13 by means of a roller 17 whilst the vertical arm 18 of said lever is applied against the operating rod 19 of the electromagnet 6.

A tension spring 20 having a low stiffness coefficient is attached to a stationary member 21 and produces action on the lever 11 by tending to cause this latter to pivot in the direction of separation of the bearing surfaces 9, 12 (as indicated by the arrow E).

A tension spring 22 having a low stiffness coefficient and attached to the end wall of the casing 3 produces action on the lever 15 so as to apply this latter against the operating rod or plunger 19 of the electromagnet (as indicated by the arrow G).

For the sake of enhanced simplicity, the components of the ski binding which serve to control the electromagnet such as dry-cell unit and microprocessor have not been shown in the drawings.

The operation of the locking device takes place as follows: in the normal skiing position, the heel-gripping member 4 maintains the rear end of the ski boot applied against a portion 1*a* of the plate 1 which forms a heel support.

The heel-gripping member 4 is locked in its boot-retaining position by means of locking levers 11 and 15 which occupy the locked position shown in FIG. 1.

Figure 2:
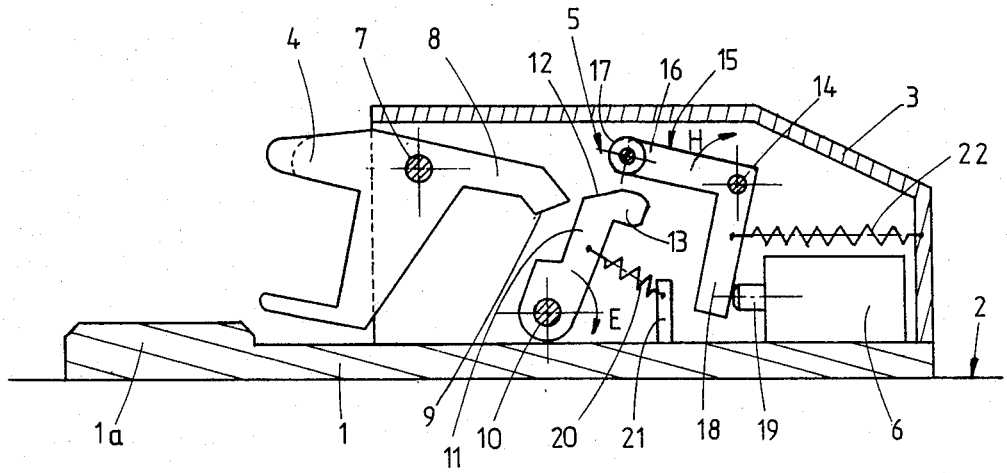
FIG. 2 shows the device after unlocking.

The trip signal which is delivered to the electromagnet when the traction force T (as shown in FIG. 1) exerted by the ski boot on the heel-gripping member 4 becomes dangerous initiates displacement of the operating rod 19 (as shown in FIG. 2). Said rod thrusts back the lever 15 in opposition to the spring 22; the lever 15 undergoes a pivotal displacement about the cross-pin 14 in the direction H opposite to the direction of the arrow G and the roller 17 of the arm 16 moves away from the projecting portion 13 of the lever 11. Under the action of the spring 20, the lever 11 undergoes a pivotal displacement about the cross-pin 10 in the direction of the arrow E and the bearing surface 12 moves away from the surface 9 of the heel-gripping member 4. Said member is therefore free to swing vertically upwards and the ski boot is thus permitted to escape from the heel-gripping member.

Figure 3:
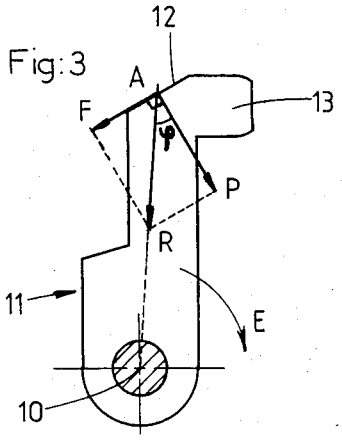
FIG. 3 is a diagram to a larger scale showing the forces exerted on the locking lever.

FIG. 3 is a view to a larger scale showing the locking lever 11. For the sake of simplification, the zone of mutual application between the surfaces 9 and 12 is assimilated with a point A. The vertical traction force $\vec{T}$ applied to the heel-gripping member 4 generates at the point A a force $\vec{P}$, the amplitude of which is proportional to T and the direction of which is normal to the surface 12. Since the coefficient of friction between the surfaces 9 and 12 is equal by definition to $f = tg\phi$, a force $F = tg\phi$ is developed in the plane of said surfaces in opposition to the relative displacement of these latter or in other words in opposition to pivotal motion of the lever 11 in in the direction of the arrow E, that is, in the direction of unlocking.

The force $\vec{R}$ which is the resultant of $\vec{P}$ and $\vec{F}$ consequently forms an angle $\phi$ with the normal to the bearing surfaces 9, 12. In point of fact, according to the invention, the straight line which joins the bearing zone (assimilated with the point A) to the axis of the pivot-pin 10 of the lever 11 also forms the angle $\phi$ with the normal to the bearing surfaces 9, 12. The result thereby achieved is that the moment applied by the force R on the lever 11 is zero and that the unlocking operation can be obtained by means of an extremely low level of power.

In fact, since the parasitic moment applied to the lever 11 is zero, the parasitic friction set up between the projecting portion 13 and the roller 17 of the lever 15 is also zero. In consequence, during a lever trip, the electromagnet has to overcome only the negligible forces exerted by the small springs 20 and 22.

In order to restore the mechanism to the locked position from the unlocked position of FIG. 2, this operation is carried out by hand by means of any suitable cam (not shown in the drawings for the sake of simplification). This cam can be mounted on a spindle disposed transversely with respect to the casing 3 between the levers 11 and 15. The cam may be so arranged that its rotation in the appropriate direction produces a pivotal displacement of the levers 11, 15 from the position shown in FIG. 2 to the locked position of FIG. 1.

It is readily apparent that the locking device according to the invention could also be adapted to a front stop for releasing the ski boot laterally in the event of excessive twisting forces, or to a multidirectional binding of the universal-joint type which is capable of releasing the ski boot both vertically and laterally. This adaptation is possible by making minor modifications within the capacity of anyone versed in the art.

What is claimed is:

1. In a safety ski binding locking and release mechanism for holding a ski boot upon a ski, the improvement comprising a compound lever having a forwardly extending portion adapted to engage the sole of a ski boot and a rearwardly extending portion having a slanting surface normally extending forwardly and downwardly when said forwardly extending portion is in normal engagement with the ski boot, means pivotally mounting said compound lever on said ski about a transverse axis between said forwardly and rearwardly extending portions, a second lever pivotally mounted on said ski about a transverse axis at its lower end, and having at its upper end a forwardly and downwardly extending first surface normally engaging the slanting surface of the rearwardly extending portion of said compound lever, and a second bearing surface extending rearwardly from said first surface, a third right-angled lever pivotally mounted about a transverse axis on said ski having a normally horizontal forwardly extending arm whose end bears against the second bearing surface of said second lever, and a normally downwardly extending arm, an electromagnet having a plunger mounted on said ski with the end of its plunger contacting the lower end of said downwardly extending arm, first spring means urging the end of said downwardly extending arm to a vertical position against the end of said plunger and the end of said forwardly extending arm against the second bearing surface of said second lever, and second spring means urging said second lever in a rearward direction about its pivot, its second bearing surface against the front end of said forwardly extending arm of the third lever and its first surface against the slanting surface of said compound lever to hold the forwardly extending portion of the latter against the ski boot, whereby upon energization of said electromagnet in response to extraordinary vertical forces upon the ski boot, its plunger acts upon the downwardly extending arm of the third lever against the action of said first spring to rotate said third lever upwardly to disengage the front end of the forwardly extending arm from the second bearing surface of said second lever, whereupon said second lever pivots rearwardly under the action of said second spring and said compound lever is permitted to pivot to release the ski boot under the action of the upward forces thereon.

2. In a safety ski binding mechanism according to claim 1, the improvement comprising a roller rotatably mounted on the end of the forwardly extending arm of said third lever in contact with the second bearing surface of said second lever.

3. In a safety ski binding mechanism according to claim 1, the improvement comprising a housing mounted on said ski enclosing said levers, springs and electromagnet, and in which said housing pivotally supports said levers.

* * * * *